US007172177B2

(12) United States Patent
Durda

(10) Patent No.: US 7,172,177 B2
(45) Date of Patent: Feb. 6, 2007

(54) AERATOR

(75) Inventor: Daniel J. Durda, Tonka Bay, MN (US)

(73) Assignee: Aeration Industries International, Inc., Chaska, MN (US)

( * ) Notice: Subject to any disclaimer, the term of this patent is extended or adjusted under 35 U.S.C. 154(b) by 0 days.

(21) Appl. No.: 10/826,425

(22) Filed: Apr. 15, 2004

(65) Prior Publication Data

US 2005/0230855 A1 Oct. 20, 2005

(51) Int. Cl.
*B01F 3/04* (2006.01)

(52) U.S. Cl. ..... 261/28; 261/87; 261/93; 261/120

(58) Field of Classification Search ..... 261/28, 261/84, 87, 91, 93, DIG. 71, DIG. 75, 120
See application file for complete search history.

(56) References Cited

U.S. PATENT DOCUMENTS 3,210,053 A * 10/1965 Boester ..... 261/6
3,775,307 A * 11/1973 McWhirter et al. ..... 210/629
3,776,531 A * 12/1973 Ebner et al. ..... 261/87
3,778,233 A * 12/1973 Blough et al. ..... 422/225
3,975,469 A 8/1976 Fuchs
4,045,522 A 8/1977 Nafziger
4,216,091 A 8/1980 Mineau
4,240,990 A 12/1980 Inhofer et al.
4,280,911 A 7/1981 Durda et al.
4,290,979 A 9/1981 Sugiura
4,308,138 A 12/1981 Woltman
4,308,221 A 12/1981 Durda
4,409,100 A 10/1983 Rajendren
4,431,597 A 2/1984 Cramer et al.
4,581,521 A 4/1986 Grise
4,587,064 A 5/1986 Blum
4,676,654 A * 6/1987 Fleckner ..... 366/98
4,732,682 A 3/1988 Rymal
4,741,825 A 5/1988 Schiller
4,741,870 A 5/1988 Gross
4,774,031 A 9/1988 Schurz
4,806,251 A 2/1989 Durda
4,844,816 A 7/1989 Fuchs et al.
4,844,843 A 7/1989 Rajendren
4,882,099 A 11/1989 Durda et al.
4,909,936 A * 3/1990 Arbisi ..... 210/220
4,954,295 A 9/1990 Durda
4,997,557 A * 3/1991 Andersen ..... 210/142
5,011,631 A * 4/1991 Hwang ..... 261/30
5,021,159 A 6/1991 Bliss et al.
5,078,923 A 1/1992 Durda et al.
5,110,510 A 5/1992 Norcross (Continued)

FOREIGN PATENT DOCUMENTS

WO WO 02/38510 A1 * 5/2002

*Primary Examiner*—Scott Bushey
(74) *Attorney, Agent, or Firm*—Crompton, Seager & Tufte LLC

(57) ABSTRACT

An apparatus for use in fluid agitation which may include a hollow drive shaft having a first end and a second end wherein the first end is coupled to a selectively rotatable power source, a first propeller, a second propeller and an atomizer coupled to the drive shaft, and a submergible vortex control plate disposed above the first propeller, and may also include a forced air source in fluid connection with the drive shaft, and methods of use thereof.

36 Claims, 3 Drawing Sheets

U.S. PATENT DOCUMENTS

| | | | | | |
|---|---|---|---|---|---|
| 5,116,501 | A | | 5/1992 | House | |
| 5,160,667 | A | | 11/1992 | Gross et al. | |
| 5,213,718 | A | | 5/1993 | Burgess | |
| 5,223,130 | A | | 6/1993 | Valfrido | |
| 5,261,783 | A | | 11/1993 | Noyes | |
| 5,275,762 | A | | 1/1994 | Burgess | |
| 5,300,261 | A | | 4/1994 | Von Berg | |
| 5,312,567 | A | | 5/1994 | Kozma et al. | |
| 5,354,457 | A | | 10/1994 | Becchi | |
| 5,356,569 | A | | 10/1994 | Von Berg | |
| 5,681,509 | A | * | 10/1997 | Bailey | 261/87 |
| 5,741,443 | A | | 4/1998 | Gemza | |
| 5,744,072 | A | | 4/1998 | Karliner | |
| 5,795,504 | A | * | 8/1998 | Berchotteau | 261/30 |
| 5,851,443 | A | | 12/1998 | Rajendren | |
| 5,868,091 | A | | 2/1999 | Gross et al. | |
| 5,988,604 | A | | 11/1999 | McWhirter | |
| 5,996,977 | A | | 12/1999 | Burgess | |
| 6,022,476 | A | | 2/2000 | Hausin | |
| 6,050,550 | A | | 4/2000 | Burgess | |
| 6,103,123 | A | | 8/2000 | Gantzer | |
| 6,126,361 | A | | 10/2000 | Gardiner | |
| 6,224,041 | B1 | | 5/2001 | Rebori et al. | |
| 6,276,670 | B1 | | 8/2001 | Jacobs | |
| 6,325,842 | B1 | | 12/2001 | Caldwell et al. | |
| 6,328,289 | B1 | | 12/2001 | Becchi | |
| 6,514,410 | B1 | | 2/2003 | Gantzer | |
| 6,556,930 | B1 | | 4/2003 | Lueck | |
| 6,609,070 | B1 | | 8/2003 | Lueck | |
| 6,634,626 | B2 | * | 10/2003 | Petrescu et al. | 261/92 |
| 2004/0168967 | A1 | * | 9/2004 | Thompson et al. | 210/242.1 |

* cited by examiner

AERATOR

FIELD

The present invention relates to an aerator for treatment of fluid. More particularly, the present invention relates to an optionally air-assisted propeller aerator for the mixing and oxygen-level control of a fluid.

BACKGROUND

Aeration processes are utilized in the treatment of fluid for the purpose of mixing and increasing the dissolved oxygen (DO) content of the fluid. When used in a waste water treatment process, bacteria and other micro-organisms are supplied with oxygen to breakdown organic matter within the waste water in a purification process. In other applications, aeration processes are used in the treatment of water to meet the dissolved oxygen requirements for supporting fish and other aquatic organisms, in aquaculture, for example.

Known aeration apparatuses include surface aerators, diffuser/blowers, and rotor aerators. Surface aerators pump water upward and throw water into the air. Surface aeration systems require high horsepower and consume high amounts of energy in pumping water against the force of gravity. In blower/diffuser systems, forced air is introduced through diffusers at the bottom of a basin. Higher horsepower is required to pressurize atmospheric air to overcome the water head resistance. Oxygen rises vertically and escapes quickly before effective dispersion into water can take place. Rotor aerators consist of rotating aerators positioned at the surface of the water receiving treatment. Rotor systems have been known to be expensive to maintain and are high in energy consumption. They cast water into the air, creating an aerosol environment which releases offending odors into the air. Rotor systems are often used in cooling applications.

Another known type of aeration apparatus is an aspirator type aerator. These devices use an electrical motor driven rotating propeller disposed below the surface of the substance being treated. The propeller imparts a directed fluid flow over an air injection port, thereby producing an area of reduced pressure that draws in atmospheric air from an intake port through a draft tube and discharges it into the substance, e.g., the waster water being treated or the water containing marine life. Aspirator type aerators may be operated generally horizontally, creating a horizontal rather than vertical flow pattern within a treatment basin.

Known aspirator type aeration apparatus include Inhofer et al., U.S. Pat. No. 4,240,990 (Aeration Propeller and Apparatus); Durda et al., U.S. Pat. No. 4,280,911 (Method for Treating Water); Schiller, U.S. Pat. No. 4,741,825 (Mobile Vortex Shield); Schurz, U.S. Pat. No. 4,774,031 (Aerator); Durda, U.S. Pat. No. 4,806,251 (Oscillating Propeller Type Aerator Apparatus and Method); Fuchs et al., U.S. Pat. No. 4,844,816 (Method of Aeration at Specific Depth and Pressure Conditions); Rajendren, U.S. Pat. No. 4,844,843 (Waste Water Aerator having Rotating Compression Blades); Gross, U.S. Pat. No. 4,741,870 (Apparatus for Treatment of Liquids); and Durda, U.S. Pat. No. 4,954,295 (Propeller Aerator with Peripheral Injection of Fluid and Method of Using the Aerator).

The above known aerators require high speed propellers to create the vacuum for drawing in atmospheric air from an intake port and discharging it into the substance. Accordingly, these known aerators use high amounts of energy to create the vacuum.

SUMMARY

One embodiment of the present invention pertains to an apparatus for use in aeration or mixing of a fluid. In this embodiment, the apparatus includes a tubular drive shaft having a first end and a second end, wherein the first end is coupled to a selectively rotatable power source. A forced air source may be in fluid communication with the tubular drive shaft. The apparatus may include a first propeller positioned on the drive shaft and a second propeller positioned on the drive shaft further towards the second end of the drive shaft. The first propeller may be larger than the second propeller.

The embodiment may also include a atomizing mechanism located proximate to the second end of the propeller shaft. The atomizing mechanism may also be used as a vacuum-balance-assist mechanism to draw forced air from the drive shaft lumen. The atomizing mechanism generally includes a plurality of blades, which may be substantially flat or may be curved.

In another embodiment, a vortex shield may be disposed over the first propeller or over the first propeller, the second propeller and the atomizer. The vortex shield may be a flat plate and may have a plurality of holes therein. The vortex shield may be, for example, a metal grill. In use, the vortex shield may be submerged in the fluid to prevent the formation of vortexes, cavitations or the like.

In another embodiment, the apparatus includes a power source configured to rotate at an extremely low speed, 750 RPM or 900 RPM, for example. This low speed operation may reduce the energy required for a given rate of oxygen introduction into the fluid, enhancing the operating efficiency.

The above summary of some example embodiments is not intended to describe each disclosed embodiment or every implementation of the present invention. The figures and detailed description which follow more particularly exemplify these embodiments.

BRIEF DESCRIPTION OF DRAWINGS

The invention may be more completely understood in consideration of the following detailed description of various embodiments of the invention in connection with the accompanying drawings in which.

Figure 1:
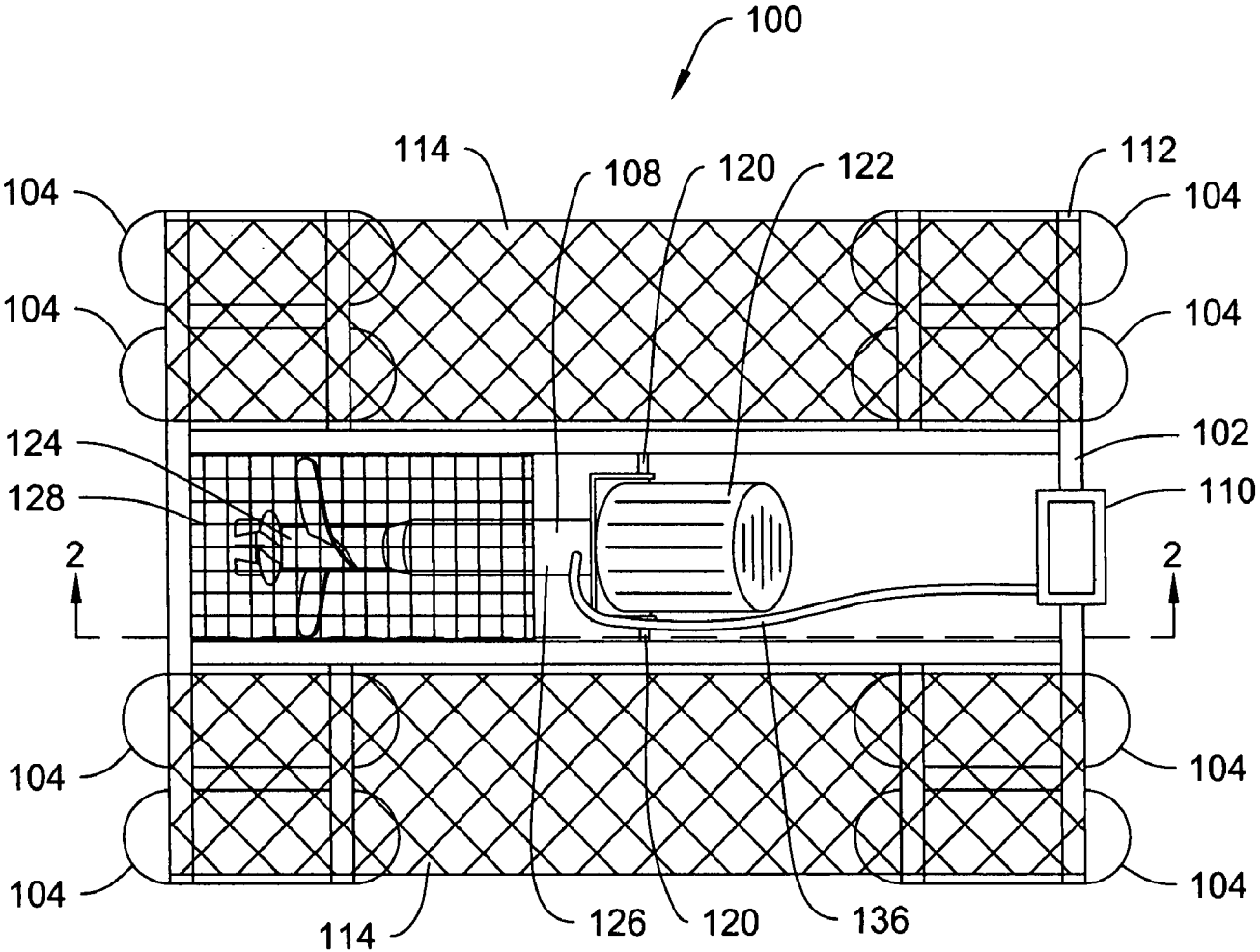
FIG. 1 is top view of an aerator assembly 100.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF SELECTED EMBODIMENTS

The following detailed description should be read with reference to the drawings in which similar elements in different drawings are numbered the same. The drawings, which are not necessarily to scale, depict illustrative embodiments and are not intended to limit the scope of the invention.

U.S. Pat. No. 5,744,072 to Karliner, entitled "Method of Treating Waste Water", is hereby incorporated by reference.

FIG. 1 is a top schematic view of an aeration system 100, which includes an aerator 108 coupled to a forced air source 110. It should be understood that labeling item 108 "aerator" is not intended to limit it to aeration applications. Aerator 108 may also be used for mixing, nitrification, or denitrification applications, for example. Aerator 108 and forced air source 110 may be coupled to float support structure 112.

In one embodiment, float support structure 112 may include frame 102 and floats 104. Frame 102 may be a rigid frame such as, for example, one made using hollow steel tubing. The tubing may be rectangular and may be filled with foam. Floats 104 may be bolted or otherwise secured to frame 102 and may be configured so that aeration system 100 is substantially level when in operation. Float support structure 112 may include a deck 114 mounted to the frame. Deck 114 provides a surface which provides suitable support for personnel during testing, maintenance or other activity, and should provide ready access to the equipment. Deck 114 may be made from, for example, a steel grillwork. Deck 114 may include railings, knee wall, handgrips or other additional structure.

Aerator mounting brackets 120 may be attached to frame 102. Mounting brackets 120 may be configured so that aerator 108 may be adjustably or movably retained so that aerator may be rotated about an axis extending through mounting brackets 120.

Aerator 108 includes motor 122 mechanically connected to bladed end 124 through shaft 126. Positioned above bladed end 124 may be a vortex shield 128. Vortex shield 128 is generally a flat plate that may have holes extending therethrough. It may be, for example, a metal grillwork or mesh. It may be positioned so that it is submerged in the fluid and may be attached to frame 102 or other suitable structure. The attachment may be lengths of chain or may be rigid or flexible struts. The attachment may also permit the easy adjustment of the depth or position of vortex shield 128. Vortex shield 128 breaks up the currents created in the fluid by bladed end 124 above bladed end 124 and thereby prevents vortices.

By providing a vortex shield which includes holes, the ability of the vortex shield to prevent vortices is increased over a shield having a smooth, regular surface. If the vortex shield has holes, it may be advantageous to make the holes relatively small, numerous, and closely spaced. However, solid vortex shields are also contemplated. The surface of the vortex shield facing bladed end 124 may be smooth or may have ridges, fingers, or other features. Vortex shield 128 may be substantially flat, as depicted, or may be curved, for example, in a semi-cylindrical shape, or other suitable shape.

Figure 2:
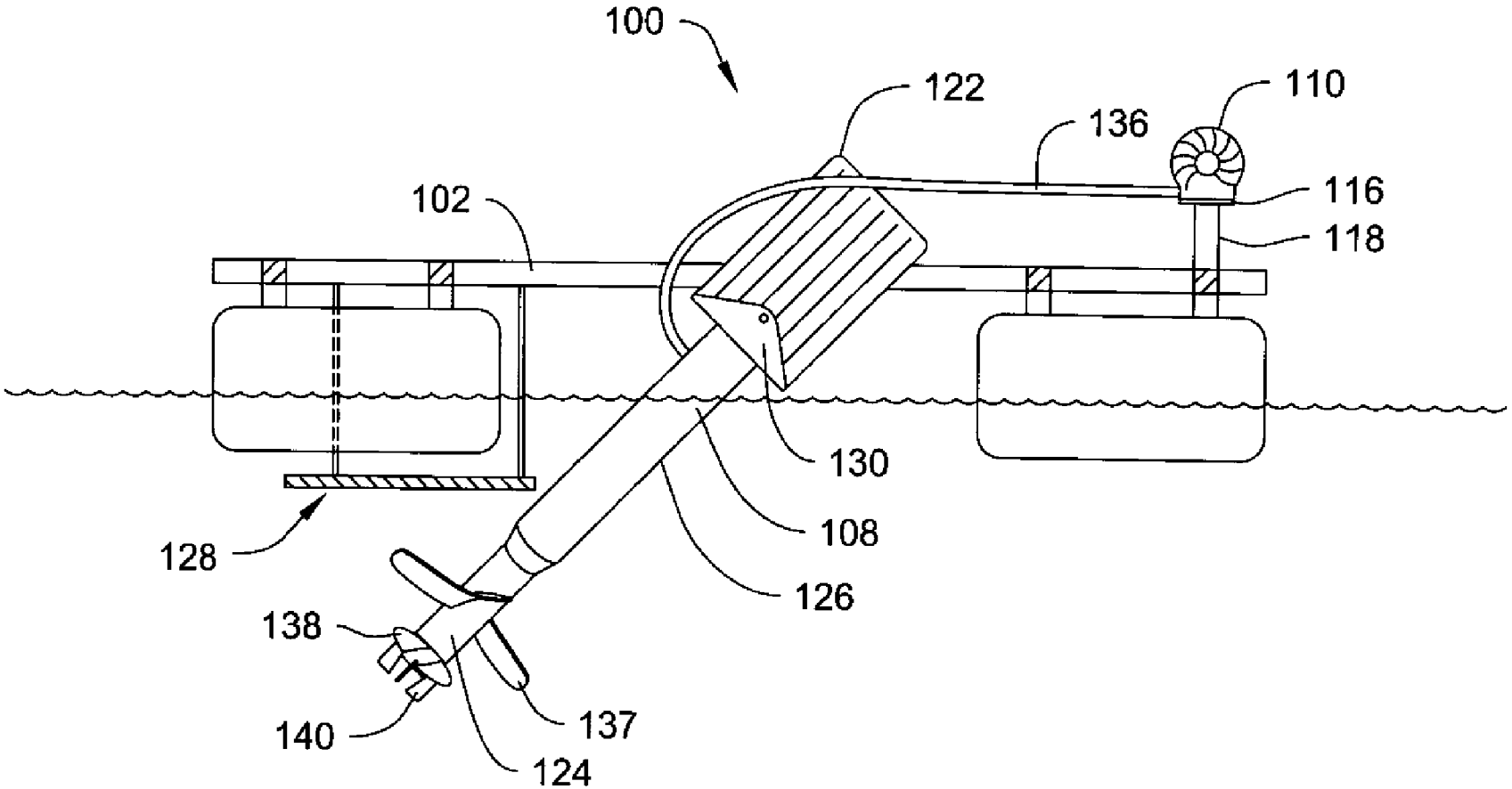
FIG. 2 is a side view of the aerator assembly 100 of FIG. 1.

Referring to FIG. 2, a side sectional view of the aeration assembly 100 of FIG. 1 is shown. Aerator 108 is generally disposed at an angle during operation so that bladed end 124 and a portion of shaft 126 are submerged in the fluid. Aerator 108 may be rotated to a preferred angle for operation or maintenance, from a vertical position to a nearly horizontal position. Aerator 108 may include a mounting bracket 130 for adjustable connection to aerator mounting brackets 120.

Attached to frame 102 may be a mounting plate 116 for the forced air source, or other suitable mounting fixture. Mounting plate 116 may be connected to frame 102 using upright support 118. Mounting plate 116 may be positioned at the rear of aerator assembly 100, as pictured, or may be positioned at another suitable location. For example, mounting bracket 116 may be position proximate the coupling with aerator 108.

Motor 122 may be an electrical motor having an electrical power source or may be other suitable motor. Motor 122 may be, for example, an 8 pole motor configured to run at 900 RPM or at 750 RPM. Motor 122 may be a variable speed motor configured to run at a selected speed. For example, motor 122 may be controllable to run at between 3500 RPM and 900 RPM. Of course, other suitable ranges are contemplated as well. Motor 122 may deliver 40-80 horsepower. It is contemplated that motor 122 may also deliver a smaller or larger amount of power, depending on the desired configuration.

Aeration assembly 100 includes a forced air source 110, which may be a regenerative blower or other suitable source. Forced air source 110 may be connected to shaft 126 with a flexible hose 136, permitting the forced air source to remain connected to aerator 108 at various positions and during rotation of aerator 108. Forced air source 110 may be configured to operate independently of aerator 108.

Figure 3:
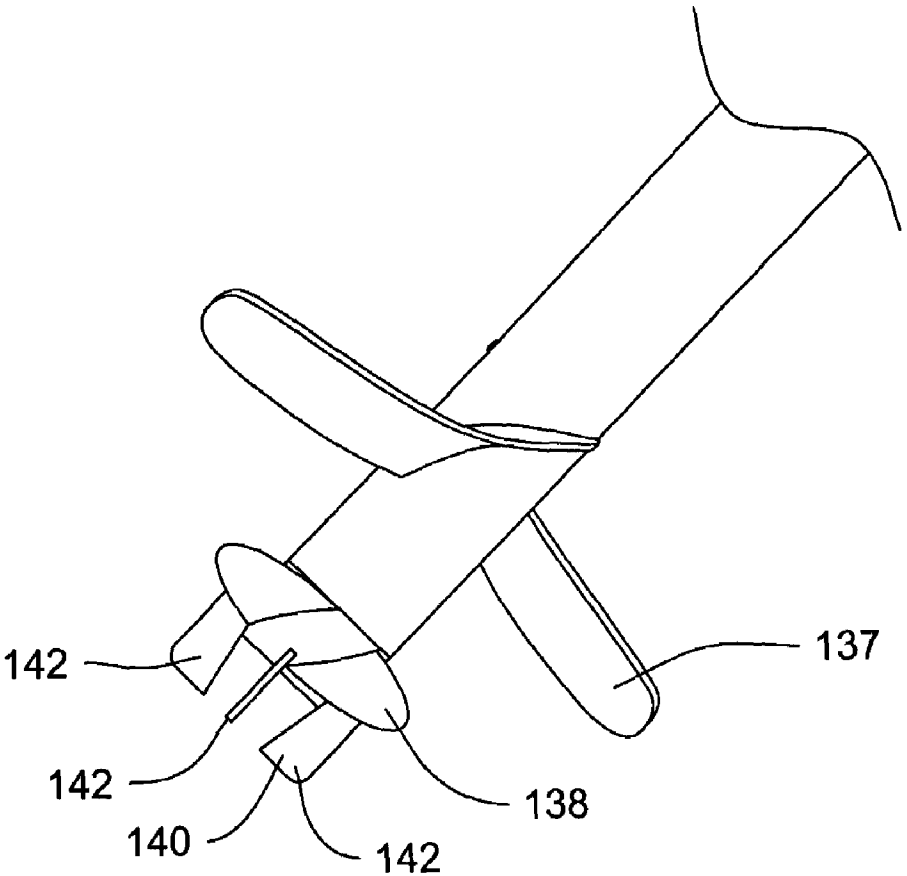
FIG. 3 is side view of bladed end 124 of aerator assembly 100 of FIG. 1.

The forced air source is fluidly connected to bladed end 124 through shaft 126. Bladed end 124 includes a primary propeller 137 and a secondary propeller 138, both having blades extending radially from the shaft. Primary propeller 137 may be positioned between secondary propeller 138 and motor 122 and may be spaced apart from secondary propeller 138 a desired distance. Primary propeller 137 may be larger than secondary propeller 138, as may be best seen in FIG. 3. The size of the primary propeller may be optimized for an operating speed. For example, as the nominal operating speed decreased, the size of the propeller may increase. For example, if the nominal operating speed is 900 RPM a primary propeller having a diameter between 16 inches and 20 inches may provide enhanced mixing capability.

At the end of the shaft proximate secondary propeller 138 may be an atomizer 140. The atomizer may be proximate the secondary propeller or may be spaced from it. Atomizer 140 may include three fins 142 extending longitudinally from the end of the shaft. Fins 142 may also extend radially both outwards and inwards. The extent of the fins outward extension may be defined by the diameter of the second propeller. Fins 142 may be substantially flat or may be curved. If curved, the fin may have a semi-cylindrical, a helical curve, or a curve like a propeller. Embodiments of atomizer 140 having more than three fins or two fins are contemplated. However, a three fin configuration may be more efficient than configurations with more than three fins. A hole proximate to atomizer fins 142 may be fluidly connected to the forced air source. The hole may be located between the atomizer fins. By extending the fins radially inward, a configuration is created where the fins create a vacuum when rotated. This vacuum may assist the introduction of air through the shaft.

Other configurations of the aeration assembly are contemplated. For example, the frame and float system shown is only one of many contemplated configurations. Different configurations may be used for different sized assemblies or merely in view of different design preferences. In another variation, the aeration assembly may include a frame for mounting on a suitable surface instead of the float and frame system depicted. For example, the aeration assembly could include a frame suitable for mounting to a wall and positioning the aerator at a desired position relative to a fluid. Of course, the frame may include suitable structure to mount the vortex shield above the bladed end.

In use, the aeration assembly is positioned relative to a body of fluid so that the bladed end of the aerator is positioned at a desired depth and angle. The vortex shield, if provided, may be submerged in the fluid above the bladed end. The aerator position, the vortex shield position, the motor speed and the forced air source may also be adjusted to provide desired operation characteristics, either before or during operation. This may be done manually or by an automatic system. An automatic system may include suitable sensors, such as, for example, an oxygen sensor or an oxidation reduction potential sensor. Of course, a system may be only partially automatic. For example, the forced air source may be controlled by a controller hooked to a suitable sensor.

In one example use, the forced air source is operated to create a stream of forced air through the hose and into the shaft. The motor is also operated at, for example, 900 RPM, to rotate the propellers and the atomizer. The primary propeller moves a relatively large volume of fluid in the axial direction relative to the shaft, while the secondary propeller directs some of the fluid towards the atomizer. The atomizer fins create a vacuum to help draw the air through the shaft. As the air exits the shaft proximate the atomizer, the atomizer breaks the air into small bubbles and mixes the bubbles into the fluid flow, providing aeration and circulation of the fluid.

In another example use, the aerator may be used at higher speed to create a higher vacuum. This higher vacuum may draw more air through the shaft. In this use, the aerator may be used without the forced air source while still drawing air through the shaft.

In another example use, the aerator is used without the introduction of air. In this use, the primary and secondary propellers may be used solely to create fluid flow. As in other uses, the angle and speed of the aerator may be adjusted to provide a preferred level of mixing and fluid flow, as in, for example, a nitrification or denitrification process.

It should be understood that this disclosure is, in many respects, only illustrative. Numerous advantages of the invention covered by this document have been set forth in the foregoing description. Changes may be made in details, particularly in matters of shape, size and arrangement of parts without exceeding the scope of the invention. Those of skill in the art will readily appreciate that other embodiments may be made and used which fall within the scope of the claims attached hereto. The invention's scope is, of course, defined in the language in which the appended claims are expressed.

What is claimed is:

1. An apparatus for use in fluid agitation comprising a drive shaft having a first end and a second end wherein the first end is coupled to a selectively rotatable power source;

a first propeller coupled to the drive shaft;

a submergible vortex control plate adjustably disposed above the first propeller; and a forced air source;

wherein the drive shaft is a tubular drive shaft and wherein the forced air source is in fluid communication with the drive shaft.

2. The apparatus of claim 1, wherein the vortex control plate has a plurality of holes therein.

3. The apparatus of claim 2, wherein the vortex control plate comprises a grill.

4. The apparatus of claim 1, further comprising a second propeller disposed on the drive shaft.

5. The apparatus of claim 4, wherein the first propeller is larger than the second propeller.

6. The apparatus of claim 4, wherein the first propeller is mounted between the second propeller and the power source.

7. The apparatus of claim 1, further comprising a frame having mounting brackets for mounting the power source; and a plurality of floats mounted to the frame.

8. The apparatus of claim 7, wherein the frame levels with respect to a water surface during operation.

9. The apparatus of claim 1, further comprising an atomizer comprising a plurality of blades disposed at the second end of the drive shaft.

10. The apparatus of claim 9, wherein the plurality of blades are substantially flat.

11. The apparatus of claim 9, wherein the plurality of blades are curved.

12. The apparatus of claim 9, wherein the drive shaft is a tubular drive shaft having a lumen therethrough having an open end proximate the second end of the drive shaft, wherein the plurality of blades extend over the open end of the lumen.

13. The apparatus of claim 9, wherein the plurality of blades extend radially outward.

14. The apparatus of claim 13, further comprising a second propeller disposed on the drive shaft, and wherein a radial extent of the second propeller is greater than a radial extent of the plurality of blades of the atomizer.

15. The apparatus of claim 1, wherein the power source is configured to rotate the drive shaft at between 700 and 1000 RPM.

16. The apparatus of claim 15, wherein the power source is configured to rotate the drive shaft at between 700 and 800 RPM.

17. The apparatus of claim 15, wherein the power source is configured to rotate the drive shaft at between 750 and 950 RPM.

18. The apparatus of claim 1, wherein the forced air source is adjustable to control the amount of forced air delivered.

19. The apparatus of claim 1, wherein the forced air source is selectively operable independently of the power source.

20. An apparatus for use in fluid agitation comprising:

a tubular drive shaft having a first end and a second end wherein the first end is coupled to a selectively rotatable power source;

a forced air source fluidly connected to the drive shaft;

a first propeller coupled to the drive shaft;

a second propeller coupled to the drive shaft; and an atomizer disposed at an end of the drive shaft;

a submergible vortex shield adjustably disposed above the first propeller;

wherein the power source is configured to operate between 700 and 1000 RPM.

21. The apparatus of claim 20, wherein the first propeller is sized to create an optimal fluid flow at between 700 and 1000 RPM.

22. The apparatus of claim 20, wherein the motor is an electric 8 pole motor designed to run at 900 RPM at 60 Hz.

23. The apparatus of claim 20, wherein the vortex shield is substantially flat.

24. The apparatus of claim 20, wherein the vortex shield is curved.

25. The apparatus of claim 20, wherein the vortex shield includes a plurality of holes.

26. A method of agitating a fluid, comprising:

providing a fluid agitator having a drive shaft having a first end coupled to a selectively rotatable power source and a first propeller, a second propeller, an adjustable, submergible vortex shield, and an atomizer coupled to the drive shaft;

immersing the first propeller in the fluid; and operating the power source at a selected speed between 700 and 1000 RPM.

27. The method of claim 26, wherein the step of providing a fluid agitator further comprises the steps of providing a drive shaft having a lumen and an open end and providing a forced air source fluidly connected to the drive shaft.

28. The method of claim 26, wherein the operation of the atomizer creates a vacuum at the open end of the drive shaft, and wherein the forced air source provides air into the drive shaft lumen at substantially the same rate as the vacuum can remove air from the drive shaft lumen.

29. The method of claim 26, wherein the first propeller provides an optimal level of fluid flow at the selected speed.

30. The method of claim 29, wherein the first propeller has a diameter of between 16 and 20 inches.

31. The apparatus of claim 1, wherein the depth of the plate is adjustable.

32. The apparatus of claim 1, wherein the position of the plate is adjustable.

33. The apparatus of claim 20, wherein the depth of the shield is adjustable.

34. The apparatus of claim 20, wherein the position of the shield is adjustable.

35. The method of claim 26, wherein the depth of the shield is adjustable.

36. The method of claim 26, wherein the position of the shield is adjustable.

* * * * *